United States Patent [19]

Flament

[11] Patent Number: 4,763,851

[45] Date of Patent: Aug. 16, 1988

[54] REEL UNWINDER

[75] Inventor: Daniel Flament, Igny, France

[73] Assignee: Materiels Equipements Graphiques, Lisses, France

[21] Appl. No.: 912,115

[22] Filed: Sep. 29, 1986

[30] Foreign Application Priority Data

Sep. 30, 1985 [FR] France ..... 85 14465

[51] Int. Cl.[4] ..... B65H 19/16

[52] U.S. Cl. ..... 242/58.3

[58] Field of Search ..... 742/58.1, 58.3, 58.4, 742/58.5, 56, 67.3

[56] References Cited

U.S. PATENT DOCUMENTS

| | | | |
|---|---|---|---|
| 3,586,006 | 6/1971 | Wendt | 242/58.3 X |
| 3,730,811 | 5/1973 | Wendt | 242/58.3 X |
| 3,895,763 | 7/1975 | Tokuno | 242/58.3 |
| 4,009,841 | 3/1977 | Matalia | 242/58.3 |

*Primary Examiner*—Donald Watkins

*Attorney, Agent, or Firm*—Roylance, Abrams, Berdo & Goodman

[57] ABSTRACT

Reel unwinder (6, 7) for ensuring the continuous supply of an endless web (21), comprising, on a stand (25 to 28), two spindles (4, 5) for two reels, one in course of being unwound and the other, after the removal of the residue of used-up reel, receiving a full reel, means of maintaining a suitable web tension (9, 10, 11), means acting on its spindle to accelerate the full reel to the linear unwinding speed, the end of the full reel receiving the strip of adhesive, means of laying the web from the nearly used-up reel onto the full reel in order to effect bonding between the webs, and knives (17, 18) for cutting the web coming from the used-up reel. The laying means consist of two applicator elements (14, 15) arranged on either side of at least one guide roller (16) on a movable assembly (8) designed to put these elements and rollers into the active position near each full reel (7), and of a control (51, 56) which ensures the approach to and then the contact with the full reel for that applicator element (14, 15) located on the other side of the web (21) coming from the reel being unwound.

The movement of the carriage is preferably a translational movement.

11 Claims, 4 Drawing Sheets

REEL UNWINDER

The invention relates to a reel unwinder for ensuring the continuous supply of an endless web, comprising, on a stand, two spindles for two reels, one in course of being unwound and the other, after the removal of the residue of used-up reel, receiving a full reel, means of maintaining a suitable web tension, means acting on its spindle in order to accelerate the full reel to the linear unwinding speed, the end of the full reel receiving a strip of adhesive, means of laying the web from the nearly usedup reel onto the full reel in order to effect bonding between the webs, and knives for cutting the web coming from the used-up reel.

Reel unwinders of this type known hitherto are usually equipped with a rotary cradle which carries the two spindles of the two reels and which, at the appropriate time, can thus be brought close to the members ensuring the bonding, the latter being carried out in the same region of the apparatus.

The major disadvantage of such an arrangement is that the movable assembly consisting of the cradle and of the reels is extremely heavy. Moreover, it is unbalanced at the moment when it is moved, since one of the reels is full and the other is almost empty.

As a result, it is necessary to use extremely powerful mechanical means, themselves also heavy and bulky, with an adverse effect on the cost price of the unwinders and their ease of use.

The object of the invention is to overcome these disadvantages, and to achieve this it relates to a reel unwinder, the laying means of which consist of two applicator elements arranged on either side of at least one guide roller on a movable assembly designed to put these elements and rollers into the active position near each full reel, and of a control which ensures the approach to and then the contact with the full reel for that applicator element located on the other side of the web coming from the reel being unwound.

Preferably, in order to ensure that the active position near each full reel is assumed alternately, the removable assembly is a carriage which executes a translational movement along slides perpendicular to the plane of symmetry of the two spindles.

It will be appreciated that, as a result of this arrangement, the spindles of the reels are fixed. Furthermore, the removable assembly is composed solely of the carriage, the two applicator rollers and one or two guide rollers, thus making it possible to maneuver it quickly and easily by the use of light-weight mechanical means.

The invention thereby makes it possible to provide a continuous-feed facility for a wide range of reel unwinders, including some for which such a feed has not hitherto been viable, whether, for example, small unwinders or unwinders of relatively low speed are concerned.

In a particularly advantageous embodiment of the invention, the applicator elements are rollers, and these rollers and the guide roller or guide rollers are carried by two columns to form a symmetrical frame equipped with two axles adjacent to one another or preferably in the extension of those of the applicator rollers, these axles resting in cut-out portions integral with the carriage and one of them being retained in each of the two active positions in order to perform the function of a pivot axle by means of stops integral with the stand, the approach and contact control acting on the symmetrical frame to ensure the movement of the other axle and consequently of the other applicator roller and of the guide rollers.

Such a symmetrical frame makes it possible to provide only a single approach control and only a single contact control instead of two. Since these controls comprise in the conventional way at least one jack for the approach and usually two jacks for contact, it will easily be understood that this also results in a production saving and greater reliability.

Advantageously, since the various members of the unwinder are symmetrical relative to one plane, the axles of the knives can also be fixed and arranged on either side of this plane of symmetry.

An embodiment of the invention is now described by way of non-limiting example, with reference to the attached drawings in which.

Figure 1:
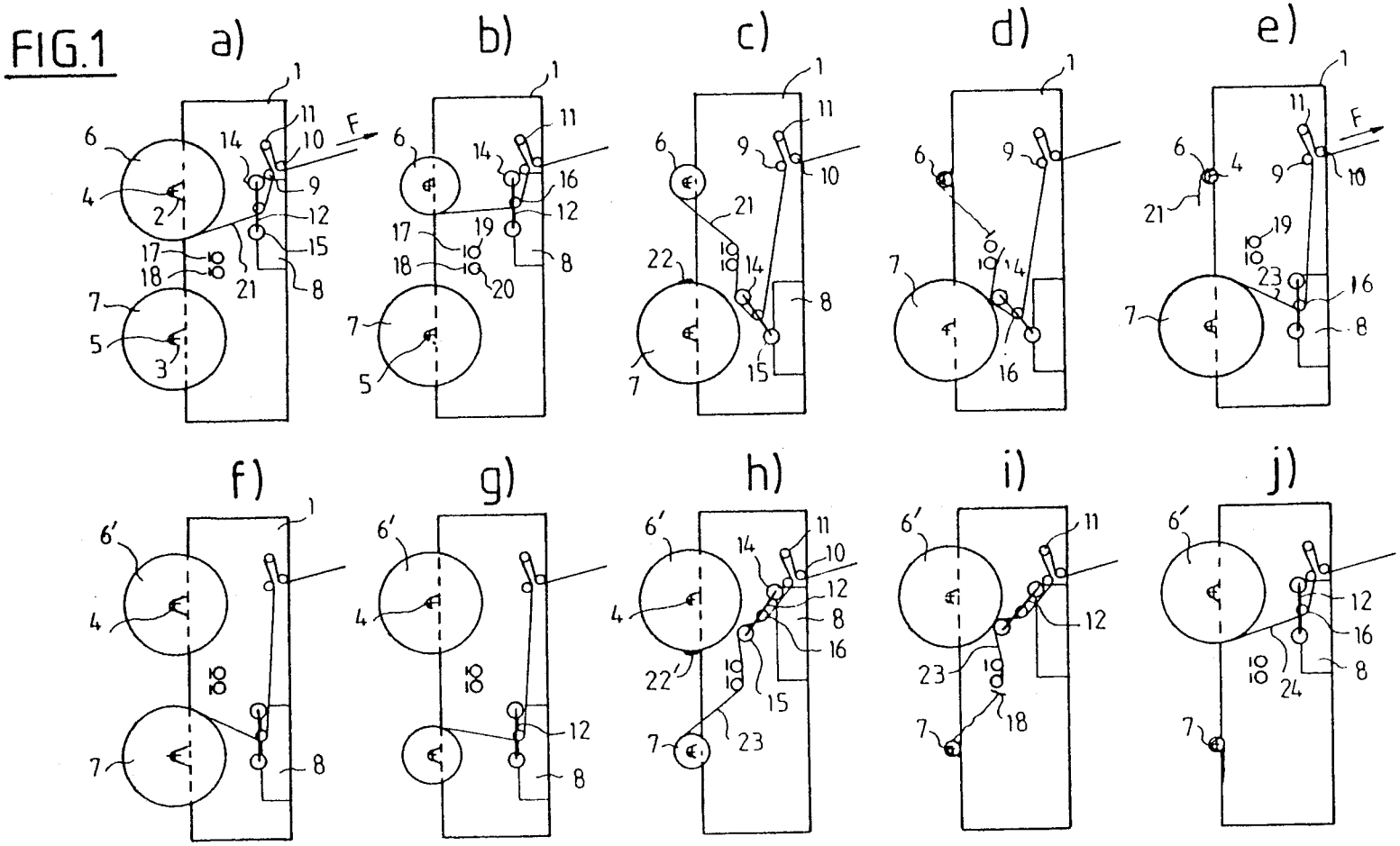
FIG. 1 shows in a highly diagrammatic way ten successive stages in the operation of a reel unwinder according to the invention, which are designated a to j.

FIG. 1 shows a reel unwinder for a printing machine, consisting in a highly diagrammatic way of a stand 1 which, by means of two brackets 2 and 3, supports two superimposed spindles 4 and 5 receiving two reels 6 and 7.

The stand 1 also accommodates a carriage 8 movable parallel to the plane containing the spindles 4 and 5 and a conventional web delivery assembly composed of two fixed rollers 9 and 10 and of a roller 11 subjected to the action of an elastic member (not shown).

The carriage 8 carries a symmetrical articulated frame consisting of two columns 12 and 13, of which only one 12 can be seen in the figure, of two applicator rollers 14 and 15 and of a guide roller 16.

Finally, two knives 17 and 18 and their supports 19 and 20 of conventional construction are arranged on either side of the plane of symmetry of the unwinder.

The continuous web 21, which here is a paper web intended for printing, is unwound from the upper reel 6 of the stage a, in order to reach the guide roller 16, then the delivery assembly 9, 10, 11 and from there, according to the arrow F, the printing machine.

At this stage, the carriage 8 is in the upper position and the frame comprising the applicator rollers 14 and 15, the columns 12 and 13 and the guide roller 16 is in the inactive position against the carriage 8.

The stage of operation b shows the reel 6 being used up, whilst the reel 7, which has been on stand-by, is rotated by controlling its spindle 5, in such a way that the peripheral speeds of the two reels are synchronized.

During the stage c, the last turns of the reel 6 are unwound and preparation is made for the bonding operation. For this purpose, the carriage 8 has been put into the lower position, and the articulated frame carrying the applicator rollers 14, 15 have experienced a rotation about an axis coinciding with that of the applicator roller 15. Thus, the web 21 bears on the guides 19 and 20 of the knives and on the applicator roller 14 which is in the approach position near the reel 7, before reaching the guide roller 16.

Stage d is the stage of bonding the end of the web 21 coming from the now empty reel 6 to the first turn of the reel 7. This bonding operation is carried out conventionally by means of a double-sided adhesive strip 22 carried by the first turn which is disengaged slightly from the following turn.

Just before this strip 22 passes under the applicator roller 14 in the approach position, the latter is put into the contact position, as shown at d, by means of a new rotation of the articulated frame, and the strip 22 ensures the bonding of the web 21 to the first turn of the reel 7. The knife 17 experiences a rotation in a way which once again is completely conventional, and its teeth penetrate into the web 21 in order to sever it; this cut can be made before, during or alternatively after the actual bonding.

The process thus moves on to stage e, at which the drive spindle 4 of the reel 6 is stopped, and the knife 17 is returned to the position of rest and the articulated frame to the inactive position along the carriage 8. The web 23 coming from the reel 7 is now unwound, passing over the guide roller 16 in order to reach the delivery assembly 9, 10, 11 and finally the printing machine.

Stage f corresponds to the unwinding of the reel 7, during which the spindle 4 has been loaded with a new full reel 6'.

When, at stage g, the reel 7 starts to be used up, the spindle 4 is rotated and the reel 6' is accelerated to a synchronous speed.

This brings about stage h, at which, with the reel 7 unwinding its last turns, a new bonding operation is prepared. For this purpose, the carriage 8 is put into the upper position and the symmetrical articulated frame into the approach position as a result of rotation, this time about an axis coinciding with that of the applicator roller 14. Thus, the web 23 is unwound along the guides 19 and 20 of the knives, the applicator roller 15 in the approach position, the guide roller 16 and the three rollers 9, 10, 11 of the delivery assembly.

Of course, the reel 6' is likewise provided with a double-sided self-adhesive strip 22', so that when, during stage i, the applicator roller 15 is put into the contact position, the web 23 is bonded to the web 24 of this reel 6'.

At the same time, the knife 18 is put into the active position and, as before, ensures the cutting of the web 23 coming from the now empty reel 7.

When the articulated frame has returned to the inactive position, as shown at j, the web 24 coming from the reel 6' follows the same path as the web 21, as illustrated at a. To return to the starting position, it only remains to replace the used-up reel 7 with a new reel.

Figure 2:
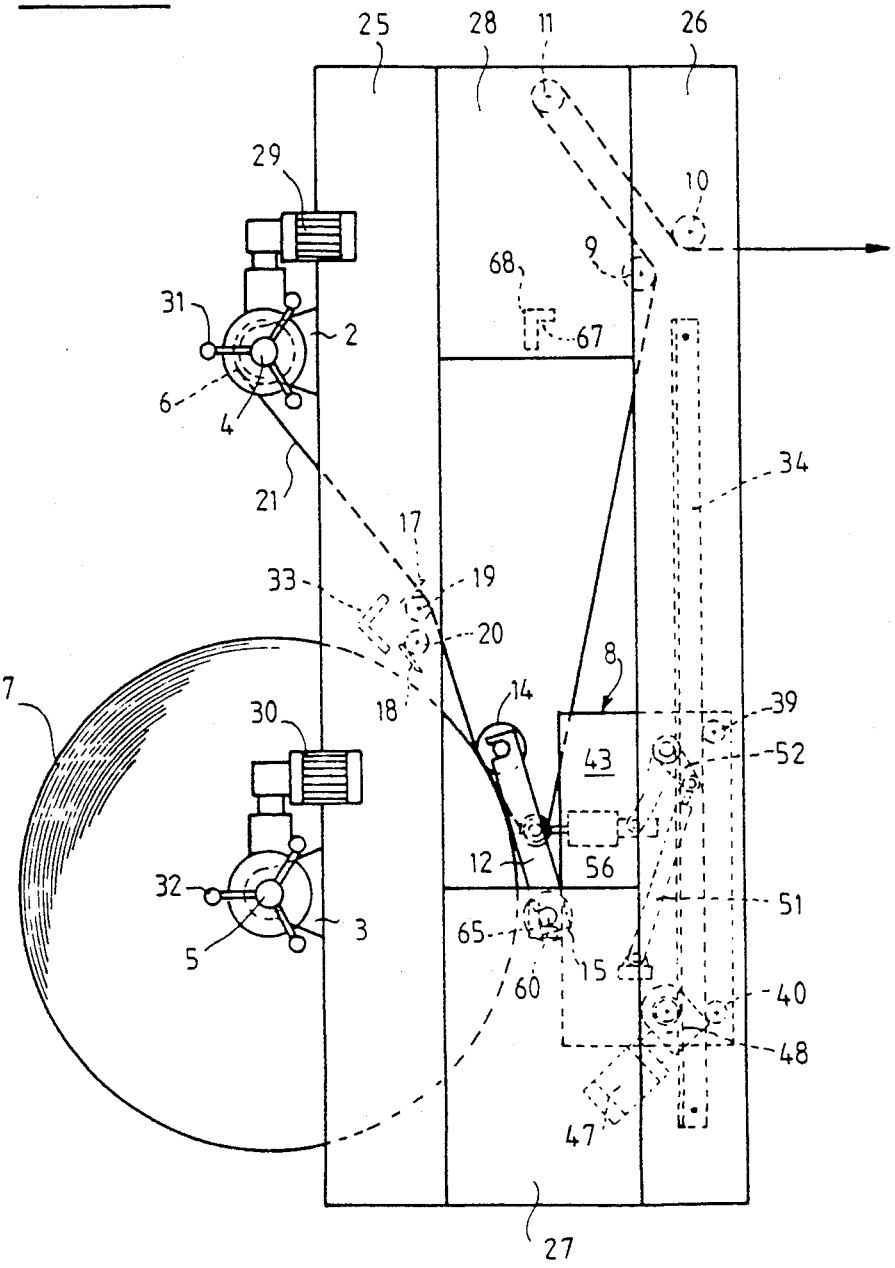
FIG. 2 is a side view of this unwinder on a larger scale.

FIG. 2 shows the general structure of the unwinder on a larger scale. Once again, there is the stand 1 which here consists of four columns, of which two 25 and 26 can be seen, a base 27, an upper strut 28 and the brackets 2 and 3 carrying the spindles 4 and 5. Since the unwinder is shown at its stage d, the spindle 4 carries a reel 6 in the course of being used up and the spindle 5 carries a full reel 7.

The motors 29 and 30 and the handwheels 31 and 32 serve to move the reels sideways.

The delivery assembly 9, 10, 11 is carried by the columns and struts 26, 28, and the knives 17, 18 with their supports 19, 20, flanked by a protective crosspiece 33 are carried by the columns 25.

Figure 3:
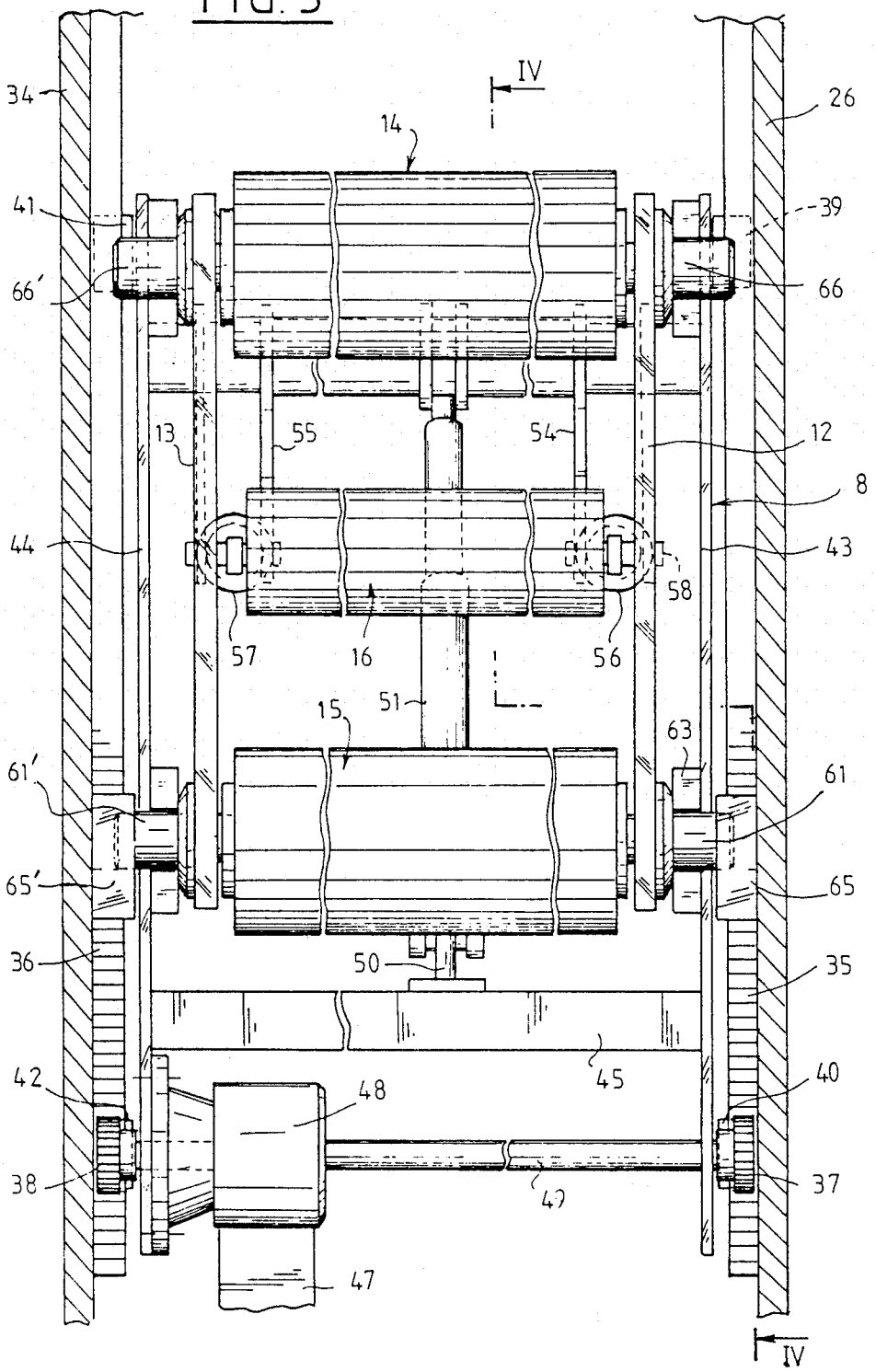
FIG. 3 is a partial transverse view on a scale enlarged even further.
Figure 4:
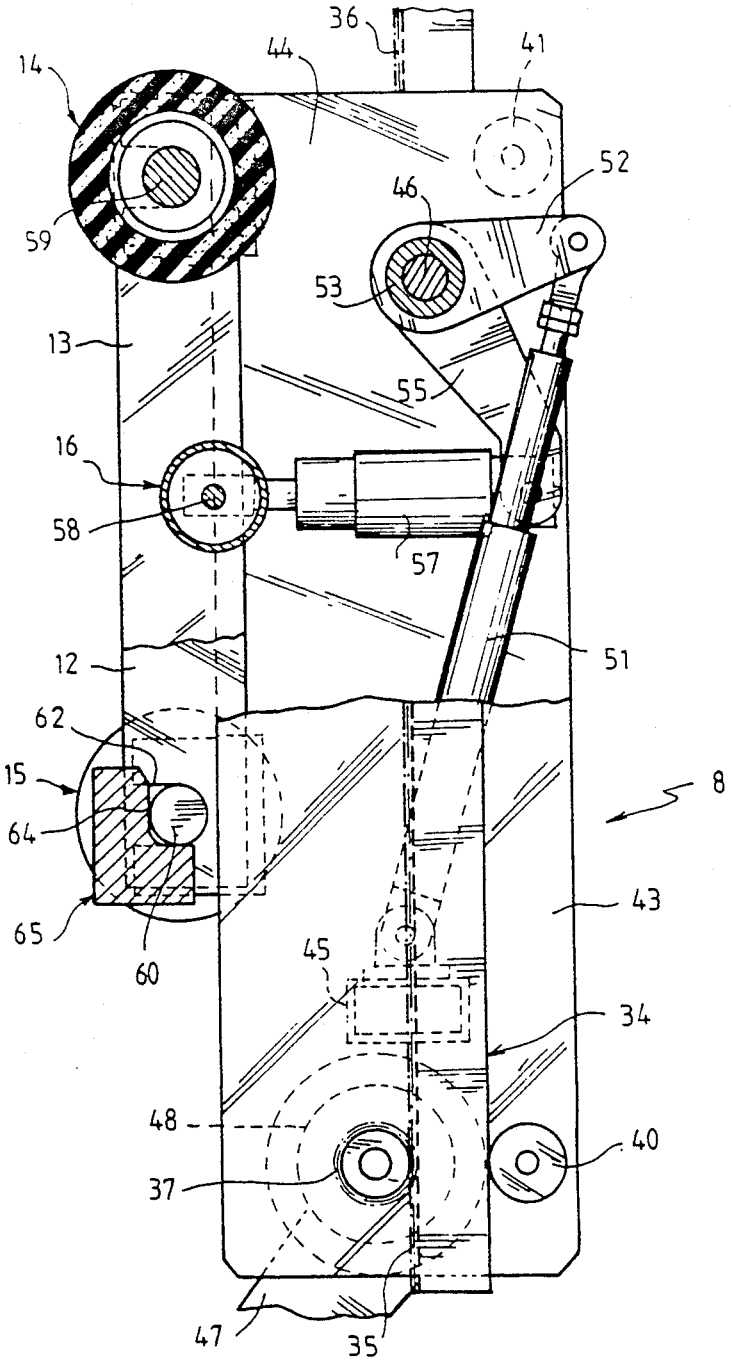
FIG. 4 is a sectional view along the line IV—IV of FIG. 3.

The movable carriage 8 and the symmetrical articulated frame carrying the rollers 14, 15 and 16, which can be seen in FIG. 2, are shown in more detail in FIGS. 3 and 4. It will be noted, in this respect, that the applicator rollers 14 and 15 carry a flexible covering.

The column 26 and that 34 symmetrical to it carry two vertical racks 35, 36 engaged with two coaxial gear wheels 37, 38 and four runners 39, 40, 41, 42. These two gear wheels and these four runners are carried by two lateral flanges 43, 44 which, together with suitable struts 45, 46, constitute the carriage 8. Thus, this carriage can be shifted in a vertical translational movement by means of a motor 47 engaged via the reduction unit 48 with a shaft 49 which carries the two gear wheels 37, 38.

The strut 45 supports the pivot 50 of a central approach jack 51 engaged with an arm 52, itself fixed to a bush 53 slipped onto the strut 46 and free to rotate.

The bush 53, near its ends, carries two symmetrical arms 54, 55 articulated on two contact jacks 56, 57, themselves engaged with the axle 58 of the guide roller 16. The axle 58 and the axles 59 and 60 of the applicator rollers 14, 15 are pivot-mounted on the columns 12 and 13.

As can be seen better in FIG. 3, the axles 59 and 60 of the applicator rollers 14, 15 project relative to the columns 12 and 13, so as to engage into bearings integral partly with the carriage and partly with the stand.

More specifically, the axle stub 61 of the applicator roller 15 is seated in a cut-out portion 62 of a block 63 integral with the flange 43 of the carriage, and when the carriage is in the lower position this same axle stub 61 rests in a seat 64 of a stop 65 integral with the column 26 of the stand. The same configuration is adopted for the symmetrical axle stub 61' and for the two axle stubs 66 and 66' of the applicator roller 14 which interacts with two blocks, themselves also bearing the reference 63, and with two stops 67 corresponding to the upper position of the carriage and visible in FIG. 2.

Thus, when the carriage is in the lower position, as shown in FIGS. 2, 3 and 4, the articulated frame can experience the rotational movement, imparted to it by the jack 51 to pass into the approach position and then by the jack 52 to pass into the contact position about the axle stub 61 and that 61' symmetrical to it, which are retained by the stops 65, whilst the axle stub 66 located at the end of the axle 59 of the roller 14 is free in the same way as that 66' symmetrical to it.

In contrast, when the carriage is in the upper position, it is the axle stubs 66 and 66' which are engaged with the stops 67, and rotation therefore takes place about the axle 59, the axle 60 then being free.

Thus, all the mechanisms making it possible to obtain the movements of the components of the unwinder which are necessary for carrying out stages a to j discussed with reference to FIG. 1 have been illustrated and described.

The motor 47 ensures the alternating up-and-down movement of the carriage 8 which advances along the racks 35, 36 by means of the gear wheels 37, 38 and the runners 39 to 42. The single approach jack 51, by means of the arm 52 of the bush 53, the arms 54, 55 and the jacks 56 and 57 in the retracted position, ensures the approach movement of the applicator roller 14 about the axle 61, 61', when the carriage is in the lower position, and of the applicator roller 15 about the axle 66, 66', when the carriage is in the upper position. The jacks 56, 57 subsequently ensure the contact movement of one or other of the applicator rollers, followed by a rotation of the knives 17, 18 about the axles of their supports 19 or 20. It will be noted that the control members of these two knives 17, 18 have not been described, since they too are completely conventional and widely used in the unwinders known hitherto.

The very simplicity of the mechanical means used in the invention makes it possible, for some uses, to provide a manual control of the movements of the carriage and jacks, but it goes without saying that more or less automated solutions can be adopted, depending on the unwinding speed and the size of the installation. For example, the movement of the carriage can remain manually controlled, whereas the approach, contact and cutting can be automated. Advantageous use will then be made of the conventional means making it possible to detect the double-sided self-adhesive strip 22 or 22' and trigger contact and cutting as a result of this detection, thus doing away with the manual positioning of the adhesive strip.

I claim:

1. A reel unwinder for continuously supplying an endless web, comprising:

two spindles mounted on a stand for supporting two reels such that the reel on one of said spindles can be unwound, while the other spindle, after removal of a consumed reel, can receive a full reel;

means for maintaining a suitable web tension;

means, coupled to each spindle, for accelerating a full reel mounted thereon to a linear unwinding speed;

a strip of adhesive adjacent a free end of each full reel;

laying means for placing a web of a nearly consumed reel on one of said spindles onto a web of a full reel on the other spindle to bond the webs of such reels by the respective strip of adhesive, said laying means including two applicator elements mounted on a common movable assembly and at least one guide roller mounted between the applicator elements for permanently passing the endless web;

driving means, coupled to said common movable assembly, for moving said applicator elements selectively into active positions near the full reel;

knife means for cutting the web from each nearly consumed reel;

first control means, acting on the apllicator element located in an active position, for moving said applicator element in the active position into an approach position at a predetermined distance from a full reel surface independent of a diameter of such full reel; and second control mean, acting on the applicator element in the approach position, for selectively moving the applicator element in the approach position into a contact position engaging a full reel to bond webs of the full reel and the nearly consumed reel.

2. A reel unwinder according to claim 1 wherein said common movable assembly is a carriage operatively coupled to said driving means for executing a translational movement along slides, said slides being parallel to a plane containing the spindles of said two reels.

3. A reel unwinder according to claim 2 wherein the applicator elements are applicator rollers; and said applicator rollers and said guide roller are carried by two columns forming a symmetrical frame, said symmetrical frame having two axles on opposite sides of said guide roller and at a distance from each other, said axles resting in cut-out portions integral with said movable assembly, stop means, integral with said stand, for retaining one of said axles in each of the active positions such that said one axle functions as a pivot axle, said first and second control means acting on the symmetrical frame for pivoting the symmetrical frame about the one axle in the stop means and for consequently bringing the applicator roller on the other axle successively into said approach and contact positions.

4. A reel unwinder according to claim 3 wherein said axles for pivoting the symmetrical frame are extensions of axles supporting the applicator rollers.

5. A reel unwinder according to claim 4 wherein said first control means comprises a central approach jack articulated on one side thereof to said movable assembly and engaged on the other side thereof with an arm fixed to a bush, said bush being rotatably mounted around a strut on the common movable assembly and carrying two symmetrical arms near one end of each symmetrical arm, said symmetrical arms being articulated at opposite ends thereof to respective ends of contact jacks, the contact jacks forming together said second control means and being connected at opposite second ends thereof with said symmetrical frame at a mid-point between said two applicator rollers.

6. A reel unwinder according to claim 5 wherein said two contact jacks are connected at said second ends thereof with an axle supporting said guide roller.

7. A reel unwinder according to claim 1 wherein the knife means are fixed and arranged on either side of a plane of symmetry between the spindles.

8. A reel unwinder according to claim 1 wherein the applicator elements are applicator rollers; and said applicator rollers and said guide roller are carried by two columns forming a symmetrical frame, said symmetrical frame having two axles on opposite sides of said guide roller and at a distance from each other, said axles resting in cut-out portions integral with said movable assembly, stop means, integral with said stand, for retaining one of said axles in each of the active positions such that said one axle functions as a pivot axle, said first and second control means acting on the symmetrical frame for pivoting the symmetrical frame about the one axle in the stop means and for consequently bringing the applicator roller on the other axle successively into said approach and contact positions.

9. A reel unwinder according to claim 8 wherein said axles for pivoting the symmetrical frame are extensions of axles supporting the applicator rollers.

10. A reel unwinder according to claim 9 wherein said first control means comprises a central approach jack articulated on one side thereof to said movable assembly and engaged on the other side thereof with an arm fixed to a bush, said bush being rotatably mounted around a strut on the common movable assembly and carrying two symmetrical arms near one end of each symmetrical arm, said symmetrical arms being articulated at opposite ends thereof to respective ends of contact jacks, the contact jacks forming together said second control means and being connected at opposite second ends thereof with said symmetrical frame at a mid-point between said two applicator rollers.

11. A reel unwinder according to claim 10 wherein said two contact jacks are connected at said second ends thereof with an axle supporting said guide roller.

* * * * *